US011840910B2

(12) United States Patent
Kishida et al.

(10) Patent No.: US 11,840,910 B2
(45) Date of Patent: Dec. 12, 2023

(54) SYSTEMS AND METHODS FOR CREATING A FLUID COMMUNICATION PATH BETWEEN PRODUCTION WELLS

(71) Applicant: Neubrex Energy Services, Inc., Bellville, TX (US)

(72) Inventors: Kinzo Kishida, Kobe (JP); Ge Jin, Houston, TX (US); Dana M. Jurick, Houston, TX (US)

(73) Assignee: NEUBREX ENERGY SERVICES, INC., Bellville, TX (US)

( * ) Notice: Subject to any disclaimer, the term of this patent is extended or adjusted under 35 U.S.C. 154(b) by 0 days.

(21) Appl. No.: 17/830,825

(22) Filed: Jun. 2, 2022

(65) Prior Publication Data

US 2023/0120731 A1 Apr. 20, 2023

Related U.S. Application Data

(60) Provisional application No. 63/255,730, filed on Oct. 14, 2021.

(51) Int. Cl.

| | |
|---|---|
| ***E21B 43/26*** | (2006.01) |
| ***E21B 49/00*** | (2006.01) |
| ***E21B 47/06*** | (2012.01) |
| ***E21B 43/12*** | (2006.01) |
| ***E21B 43/16*** | (2006.01) |

(Continued)

(52) U.S. Cl.
CPC ..... *E21B 43/26* (2013.01)

(58) Field of Classification Search
None
See application file for complete search history.

(56) References Cited

U.S. PATENT DOCUMENTS

| | | | |
|---|---|---|---|
| 9,557,196 | B2 | 1/2017 | Xue et al. |
| 9,650,855 | B2 * | 5/2017 | Caldwell ..... E21B 33/038 |
| 10,429,234 | B2 | 10/2019 | Nishiguchi et al. |

(Continued)

FOREIGN PATENT DOCUMENTS

JP 5980419 B2 8/2016

OTHER PUBLICATIONS

Ge Jin et al, "Hydraulic-Fracture Geometry Characterization Using Low-Frequency DAS Signal", The Leading Edge, Dec. 2017, 36 (12), pp. 975-980. https://doi.org/10.1190/tle36120975.1.

(Continued)

*Primary Examiner* — Matthew R Buck
*Assistant Examiner* — Douglas S Wood
(74) *Attorney, Agent, or Firm* — BUCHANAN INGERSOLL & ROONEY PC

(57) ABSTRACT

A method creates a fluid communication path between a first production well and a second production well. At least one hydraulic fracture intersects the first production well and is separated from the second production well by a wall thereof. The method includes identifying, from the second production well, a location of the hydraulic fracture of the first production well, and perforating the wall of the second production well at the identified location. The perforating creates the fluid communication path between the production wells. Injection of fracking fluid and proppant at the first production well allows for additional fluids to be extracted from the second production well, thus generating a flow between the two production wells through the hydraulic fracture.

9 Claims, 6 Drawing Sheets

(51) Int. Cl.
*E21B 43/25* (2006.01)
*E21B 43/11* (2006.01)

(56) References Cited

U.S. PATENT DOCUMENTS

| | | | | |
|---|---|---|---|---|
| 10,612,947 | B2 | 4/2020 | Kishida et al. | |
| 10,620,019 | B2 | 4/2020 | Kishida et al. | |
| 10,712,149 | B2 | 7/2020 | Kishida et al. | |
| 11,365,617 | B1 * | 6/2022 | Haustveit | E21B 47/06 |
| 11,434,740 | B1 * | 9/2022 | Ngyuen | E21B 43/26 |
| 11,500,122 | B2 * | 11/2022 | Jaaskelainen | E21B 43/26 |
| 2013/0000896 | A1 * | 1/2013 | Boone | E21B 43/2408 166/57 |
| 2016/0003017 | A1 * | 1/2016 | Keller | E21B 43/162 166/250.1 |
| 2016/0116308 | A1 | 4/2016 | Xue et al. | |
| 2018/0080309 | A1 * | 3/2018 | Althoff | E21B 43/17 |
| 2019/0003295 | A1 * | 1/2019 | Ehlig-Economides | E21B 43/305 |
| 2020/0217181 | A1 * | 7/2020 | Norbeck | F03G 4/033 |
| 2020/0270977 | A1 * | 8/2020 | Kraynek | E21B 43/26 |
| 2021/0040841 | A1 * | 2/2021 | Dusterhoft | G01V 8/16 |
| 2021/0189862 | A1 * | 6/2021 | Roussel | E21B 43/26 |
| 2022/0325621 | A1 * | 10/2022 | Moos | E21B 47/06 |

OTHER PUBLICATIONS

Gustavo Ugueto et al., "New Near-Wellbore Insights from Fiber Optics and Downhole Pressure Gauge Data", SPE-194371-MS, Society of Petroleum Engineers, Feb. 5-7, 2019. (12 pages).

Kin-zen Li, et al, "Microcracks, spall and fracture in glass: a study using short pulsed laser shock waves", J. Applied Physics, vol. 83, No. 7, Apr. 1, 1998, pp. 3583-3594.

Raterman et al., "Sampling a Stimulated Rock Volume: An Eagle Ford Example", URTeC: 2670034 Unconventional Resources Technology Conference, DOI 10.15530/urtec-20172670034, Jul. 24-26, 2017. (18 pages).

Mirko van der Baan et al., "Microseismic Monitoring Developments in Hydraulic Fracture Stimulation", Chapter 21, Proceedings of the International Conference for Effective and Sustainable Hydraulic Fracturing, May 2013, pp. 439-466, http://dx.doi.org/10.5772/56444.

Boone et al., "Monitoring Hydraulic Fracturing Operations Using Fiber-Optic Distributed Acoustic Sensing", SPE-178648-MS/URTeC:2158449, Unconventional Resources Technology Conference, Jul. 20-22, 2015. (8 pages).

J.H. Le Calvez et al., "Real-Time Microseismic Monitoring of Hydraulic Fracture Treatment: A Tool To Improve Completion and Reservoir Management", SPE 106159, Society of Petroleum Engineers, Jan. 29-31, 2007. (7 pages).

Curnow et al., "A Coupled Geomechanics and Fluid Flow Modeling Study for Hydraulic Fracture Design and Production Optimization in an Eagle Ford Shale Oil Reservoir", SPE-179165-MS, Society of Petroleum Engineers, Feb. 9-11, 2016. (12 pages).

Zhuo Dong et al., "Numerical study of near-wellbore hydraulic fracture propagation", Theoretical and Applied Fracture Mechanics 103 (2019) 102274. (17 pages).

Seyed Hassan Fallahzadeh et al., "Near Wellbore Hydraulic Fracture Propagation from Perforations in Tight Rocks: The Roles of Fracturing Fluid Viscosity and Injection Rate", Energies, 2017, vol. 10, No. 359. (23 pages).

Duncan Heddleston, "Horizontal Well Production Logging Deployment and Measurement Techniques for US Land Shale Hydrocarbon Plays", SPE 120591, Society of Petroleum Engineers, Apr. 4-8, 2009. (9 pages).

Hong Cheng-Yu et al., "Recent progress of using Brillouin distributed fiber optic sensors for geotechnical health monitoring", Sensors and Actuators A 258 (2017), pp. 131-145.

Ge Jin et al., Fiber Optic Sensing-Based Production Logging Methods for Low-Rate Oil Producers, URTeC: 943, Unconventional Resources Technology Conference, Jul. 22-24, 2019. (17 pages).

Kishida et al., "Study of Optical Fibers Strain-Temperature Sensitivities Using Hybrid Brillouin-Rayleigh System", Photonic Sensors, DOI: 10.1007/s13320-013-0136-1, Sep. 2, 2013. (11 pages).

Bethany Kurz et al., "Investigation of Improved Conductivity and Proppant Applications in the Bakken Formation", SPE 163849, Society of Petroleum Engineers, Feb. 4-6, 2013. (13 pages).

S. C. Maxwell et al., "Petroleum reservoir characterization using downhole microseismic monitoring", Geophysics, vol. 75, No. 5, (Sep.-Oct. 2010), pp. 75A129-75A137, 7 Figs. 10.1190/1.3477966.

D. Miklashevskiy et al., "New Production Logging Tool for Inflow Profiling of Low-Rate Oil and Water Horizontal Wells: Case Studies of Field Testing an Experimental Prototype", SPE-187901-MS, Society of Petroleum Engineers, Oct. 16-18, 2017. (17 pages).

Ken'ichi Nishiguchi et al., "Synthetic Spectrum Approach for Brillouin Optical Time-Domain Reflectometry", Sensors, 2014, vol. 14, pp. 4731-4754, doi:10.3390/s140304731.

Kirill Ovchinnikov et al., "Production Logging in Horizontal Wells Without Well Intervention", SPE-187751-MS, Society of Petroleum Engineers, Oct. 16-18, 2017. (14 pages).

Ryutaro Shibata et al., "Improving performance of phase shift pulse BOTDR", IEICE Electronics Express, May 11, 2017, DOI: 10.1587/elex.14.20170267. (6 pages).

Puneet Seth et al., "Poroelastic Pressure Transient Analysis: A New Method for Interpretation of Pressure Communication Between Wells During Hydraulic Fracturing", SPE-194358-MS, Society of Petroleum Engineers, Feb. 5-7, 2019. (19 pages).

Taghichian et al., "Stress shadow size and aperture of hydraulic fractures in unconventional shales", Journal of Petroleum Science and Engineering, 2014, vol. 124, pp. 209-221, http://dx.doi.org/10.1016/j.petrol.2014.09.034.

Webster et al., "Micro-Seismic Detection using Distributed Acoustic Sensing", SEG Houston 2013 Annual Meeting, DOI http://dx.doi.org/10.1190/segam2013-0182.1, pp. 2459-2463.

Zeng et al., "Optimized Design and Use of Induced Complex Fractures in Horizontal Wellbores of Tight Gas Reservoirs", Rock Mech Rock Eng (2016), vol. 49, pp. 1411-1423, DOI 10.1007/s00603-015-0802-2.

Jin et al., "Novel Near-Wellbore Fracture Diagnosis for Unconventional Wells Using High-Resolution Distributed Strain Sensing During Production", 2021 SPE Journal, SPE-205394. (10 pages).

Liu et al., "Hydraulic-Fracture-Width Inversion Using Low-Frequency Distributed-Acoustic-Sensing Strain Data Part II: Extension for Multifracture and Field Application", 2021 SPE Journal, SPE-205379. (13 pages).

P. E. et al., "Fracture Toughness of Sandstones and Shales", Chapter 41. (8 pages).

Raterman et al., "Analysis of a Drained Rock Volume An Eagle Ford Example", URTeC 263, Jul. 22-24, 2019. (20 pages).

Sorkhabi, "Locating Sweet Spots: Shale Petroleum Systems",GeoExpo, Aug. 17, 2020. (12 pages).

* cited by examiner

SYSTEMS AND METHODS FOR CREATING A FLUID COMMUNICATION PATH BETWEEN PRODUCTION WELLS

CROSS-REFERENCE TO RELATED APPLICATION

This application claims the benefit of Provisional U.S. Patent Application No. 63/255,730 filed on Oct. 14, 2021, the entire content of which is incorporated herein by reference for all purposes.

TECHNICAL FIELD

The present disclosure relates to production wells and their operation, for example for use in hydrocarbon extraction.

BACKGROUND INFORMATION

Oil and gas production from shale reservoirs represents more than 15% of global hydrocarbon production. In order to produce hydrocarbon from low-permeability rocks, hydraulic fracturing operation is commonly utilized. Hydraulic fracturing operation generates high-permeability channels that allow hydrocarbon to migrate from the reservoir rock matrix to production boreholes. The operation is often performed in long horizontal wells and in stages, where the horizontal section of the borehole is artificially divided into many smaller sections, and hydraulic fracturing injection is performed at each section sequentially from the toe (end of the well) to the heel (well section where the horizontal section starts).

For each stage, the operation sequence includes setting a plug to isolate the wellbore section of previous stages, using borehole tools to generate perforation holes in the current stage wellbore section, and injecting hydraulic fracturing fluid from the surface into the wellbore. The injected fluid flow through the perforation holes into the reservoir generates hydraulic fractures in the rocks to enhance production. The hydraulic fractures grow along the direction of maximum horizontal stress, and can extend to a length from 100 feet to 2000 feet, depending on the reservoir rock properties and conditions.

Using conventional technology, 70% or more of the oil in a reservoir can remain in the reservoir after production, and two thirds of the length of a conventional well does not produce.

The generated hydraulic fractures could close completely due to pressure depletion during the production phase. To prevent fracture closure, proppant is usually added to the injection fluid. Proppant is fine grain sand or similar particulate materials, which can serve as supporting material in the hydraulic fractures to prevent complete closure. Although hydraulic fractures and injection fluid can propagate far away from the injection well, recent studies have shown that proppant can only transfer to a limited distance compared to the entire hydraulic fracture length, as demonstrated in FIG. 1 (e.g., Raterman, Kevin T., Helen E. Farrell, Oscar S. Mora, Aaron L. Janssen, Gustavo A. Gomez, Seth Busetti, Jamie Mcewen, et al., "Sampling a Stimulated Rock Volume: An Eagle Ford Example," Unconventional Resources Technology Conference (URTEC), 2017, at 21:24-26, incorporated herein by reference for its disclosure of hydraulic fractures, injection fluid, and their propagation). This can be because fluid flow within a fracture decreases as the fracture size increases, and fluid flow velocity decreases further away from the injector. FIG. 1 illustrates a conventional well configuration 100 including a well 102 and a hydraulic fracture 104 extending by length L1, while proppant 106 inside the hydraulic fracture 104 is transported by a transportation length L2, which is much less than L1.

The distance that proppant can transfer in the hydraulic fractures can determine the actual volume of rock that the producing well can drain from, which can also significantly affect the economics of the reservoir development (Raterman, Kevin T., Yongshe Liu, and Logan Warren, "Analysis of a Drained Rock Volume: An Eagle Ford Example," URTeC2019, 2019, at 1-20, incorporated herein by reference for its disclosure of proppant propagation and determination of producing rock volume). To maximize the estimated ultimate recovery (EUR) of the reservoir, one advantageous well spacing (distance between adjacent horizontal wells) is typically twice that of the proppant transportation distance. As a result, if proppant can propagate further in the hydraulic fractures, fewer wells would be needed to deplete the same amount of reservoir volume, thus significantly reducing the cost of reservoir development.

SUMMARY

A method is disclosed for creating a fluid communication path between two production wells including a first production well and a second production well. This method can increase flow—especially the length of proppant delivery—in a hydraulically created fracture. The production wells include a first production well and a second production well. At least one hydraulic fracture intersects the first production well and is separated from the second production well by at least a wall of the second production well. The method comprises identifying, from the second production well, at least one location of the at least one hydraulic fracture of the first production well, and perforating the wall of the second production well at the at least one location. The perforating and the hydraulic fracture create the fluid communication path between the production wells. Pressure of the second production well can be released from the surface to increase flow velocity in the communication path, and force proppant to propagate further away from the first production well.

BRIEF DESCRIPTION OF THE DRAWINGS

Other features and advantages disclosed herein will become more apparent from the following detailed description of exemplary embodiments when read in conjunction with the attached drawings.

DETAILED DESCRIPTION

The present disclosure provides illustrative systems, such as two-well systems, and associated methods of operation, which can significantly increase proppant transportation distance. By virtue of the present disclosure, the production wells can be separated further than the above-noted previously optimized well spacing. Hydraulic fracture operation can be performed in a first production well. A second production well can be equipped with distributed fiber-optic sensing (DFOS) technology, to identify fracture hit locations at the second production well during injection into the first production well. A perforation gun can be lowered into the second production well to generate perforation holes in that production well, at the identified fracture hit locations. Injection of fracking fluid and proppant can then continue at the first production well, and additional fluids can be extracted from the second production well, which can generate a flow between the two production wells through the hydraulic fractures.

The above method is also suitable to re-fracture. Re-fracture refers to operation in old wells and new infill wells in a subsurface region of already-drilled wells. One purpose of re-fracture is to extract more oil out of existing production areas. Fiber optic cables can be installed in the old wells by, for instance, adding another smaller casing inside the old production casing, and equipping the smaller casing with DFOS technology. Steps similar to those set forth in the preceding paragraph can then be performed.

This enhanced flow can help transport proppant further in the created hydraulic fractures, for example by virtue of increased flow velocity in the hydraulic fractures. Proppant can thus potentially flow along the entire hydraulic fracture length between the two wells. Other potential advantages can include an increased optimal production well spacing, and a reduced number of production wells that are needed for hydrocarbon production. Moreover, longer factures can be exploited while reducing the risk of destruction of additional reservoir rock, which could otherwise reduce hydraulic fracturing efficiency of surrounding wells.

Figure 1:
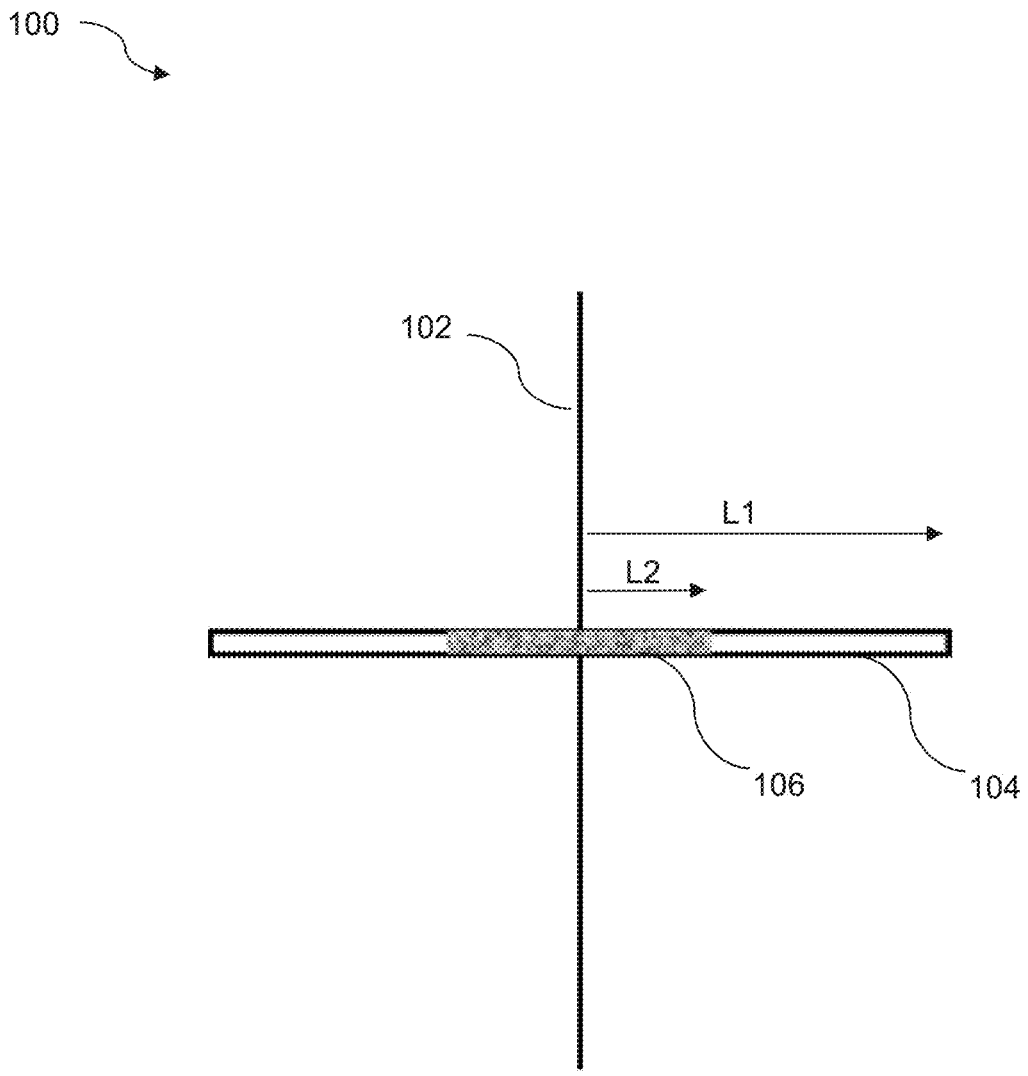
FIG. 1 is a schematic representation of a conventional well configuration.
Figure 2:
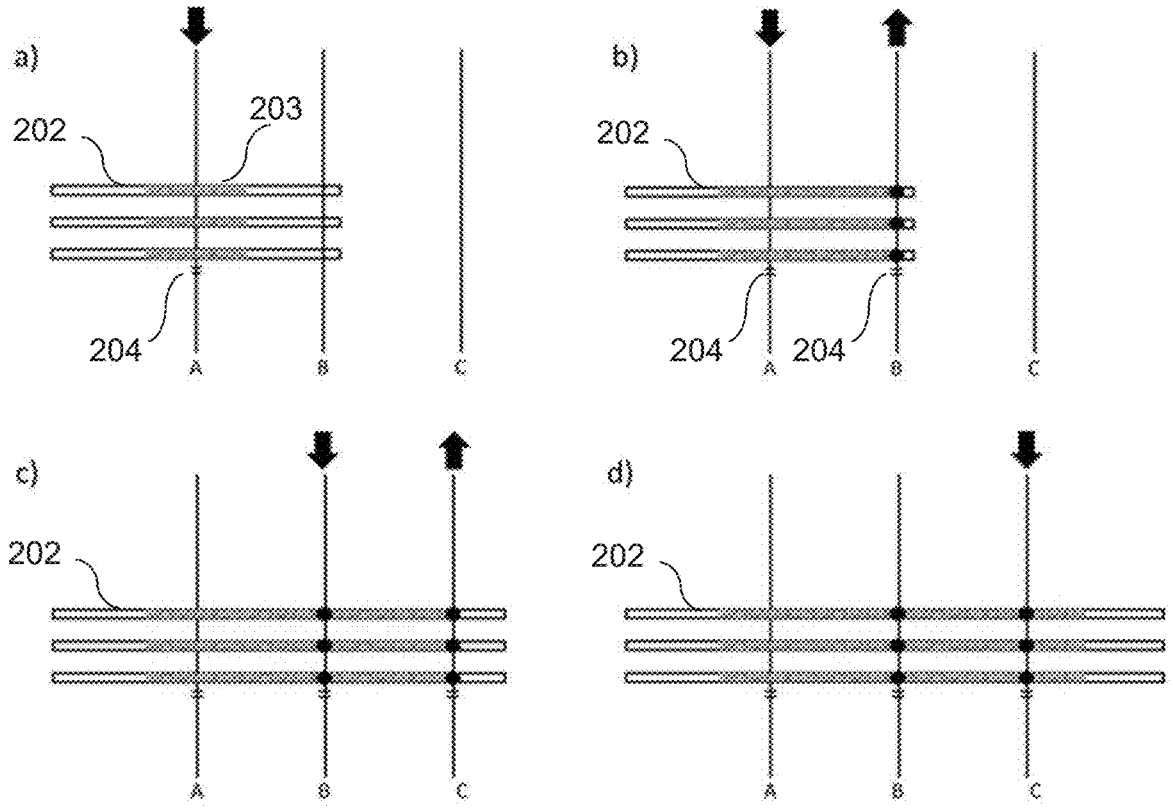
FIG. 2 illustrates schematic representations of horizontal wells subject to an exemplary method for increasing flow between production wells in accordance with the present disclosure.
Figure 3:
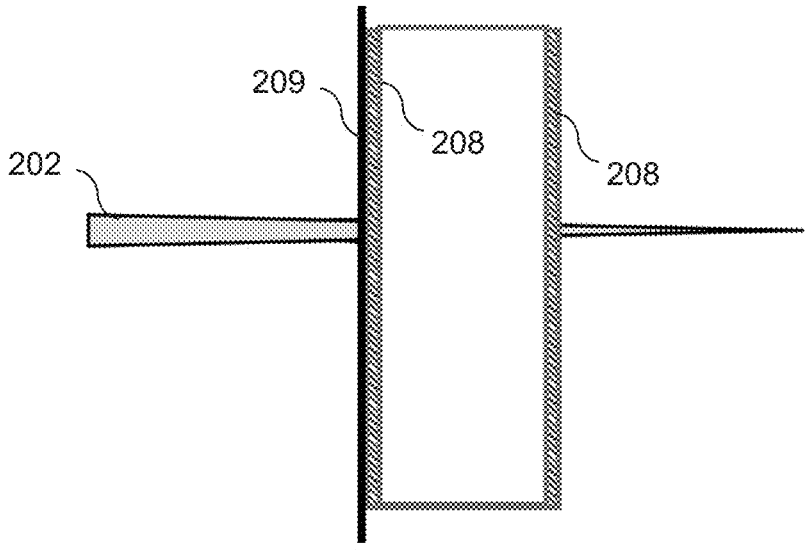
FIG. 3 shows a schematic representation of an illustrative hydraulic fracture near an illustrative production well prior to perforation, in accordance with the present disclosure.
Figure 4:
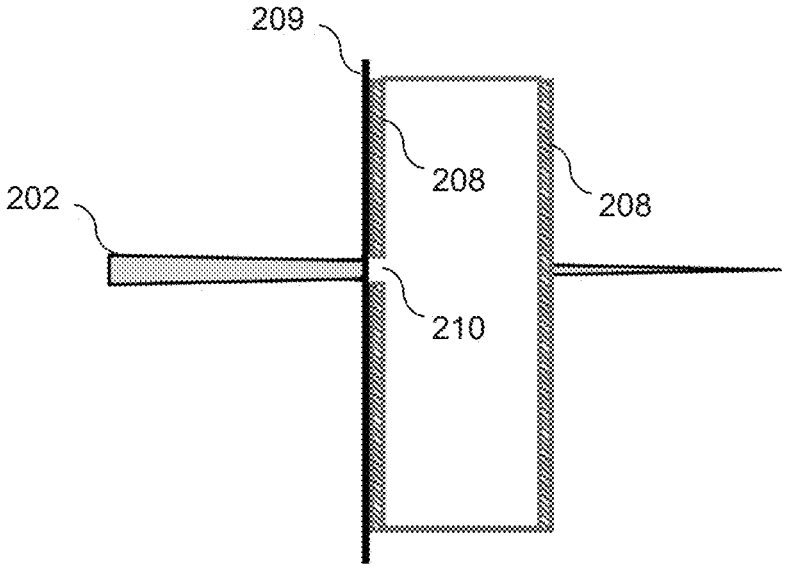
FIG. 4 shows a schematic representation of an illustrative hydraulic fracture near an illustrative production well after perforation, in accordance with the present disclosure.

FIG. 2 schematically illustrates production wells subject to an exemplary method for increasing flow between production wells according to the present disclosure. FIGS. 3 and 4 show aspects of the second production well B during operation. The wells include first, second and third production wells A, B and C. The production wells can be horizontal production wells, vertical production wells, or can be oriented at an angle relative to the horizontal plane.

The method includes hydraulically fracturing the first production well A to form at least one hydraulic fracture 202, as shown in FIG. 2(*a*). The hydraulic fracture 202 is separated from the second production well B by a wall 208 of the second production well B (shown in FIG. 3).

The method includes deploying optical sensing fibers 209 in the second production well B or at the wall 208 of the production well B (shown in FIGS. 3 and 4). The optical sensing fibers 209 are configured to sense, from the second production well B, a hydraulic fracture 202 originating from the first production well A.

The method includes identifying, from the second production well B, at least one location of the hydraulic fracture(s) 202 of the first production well A, using, for example, distributed fiber-optic sensing (DFOS) technology, for example by processing data sensed by the optical sensing fibers 209 using a hardware processor (see, e.g., Jin, et al, Novel Near-Wellbore Fracture Diagnosis for Unconventional Wells Using High-Resolution Distributed Strain Sensing during Production, SPE-205394 (2021), incorporated herein by reference for its disclosure of distributed fiber-optic sensing technology and its use). For example, fracture hit features of measured strain at a particular well depth can be indicative of the location of a hydraulic fracture 202 at that depth. The location of the fracture can be determined with a great deal of precision, e.g., less than 2 feet.

Figure 5A:
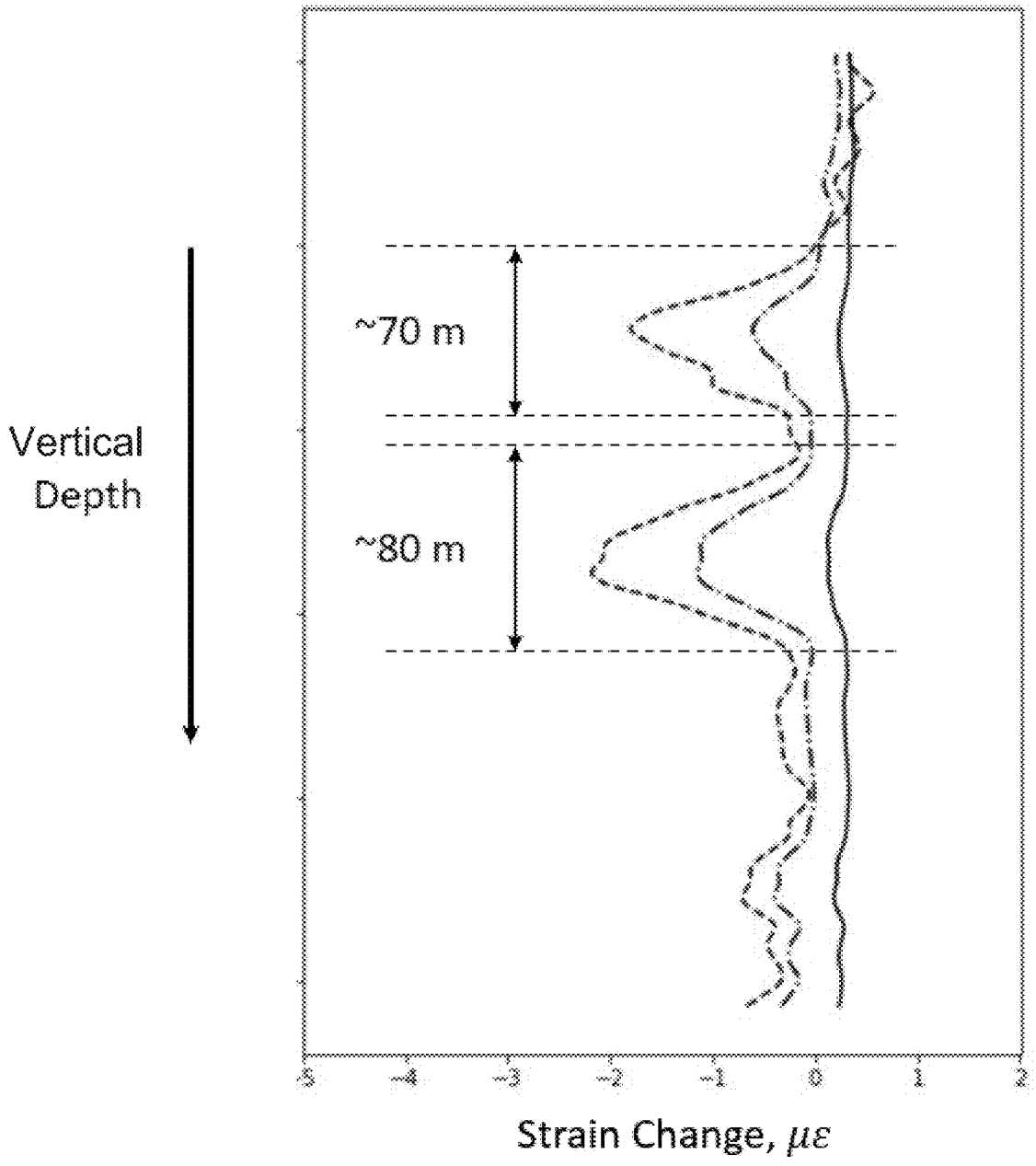
FIGS. 5A and 5B show illustrative graphical representations of distributed strain measurements in a vertical well and a horizontal well, respectively.

FIG. 5A shows an illustrative graphical representation of distributed strain measurements in a vertical well, used to identify the depth location of hydraulic fractures. These data can be obtained, for example, using DFOS measurements. Likewise, features of measured strain at a particular location along a vertical or horizontal well can be indicative of the location of the hydraulic fracture 202 along that dimension.

Figure 5B:
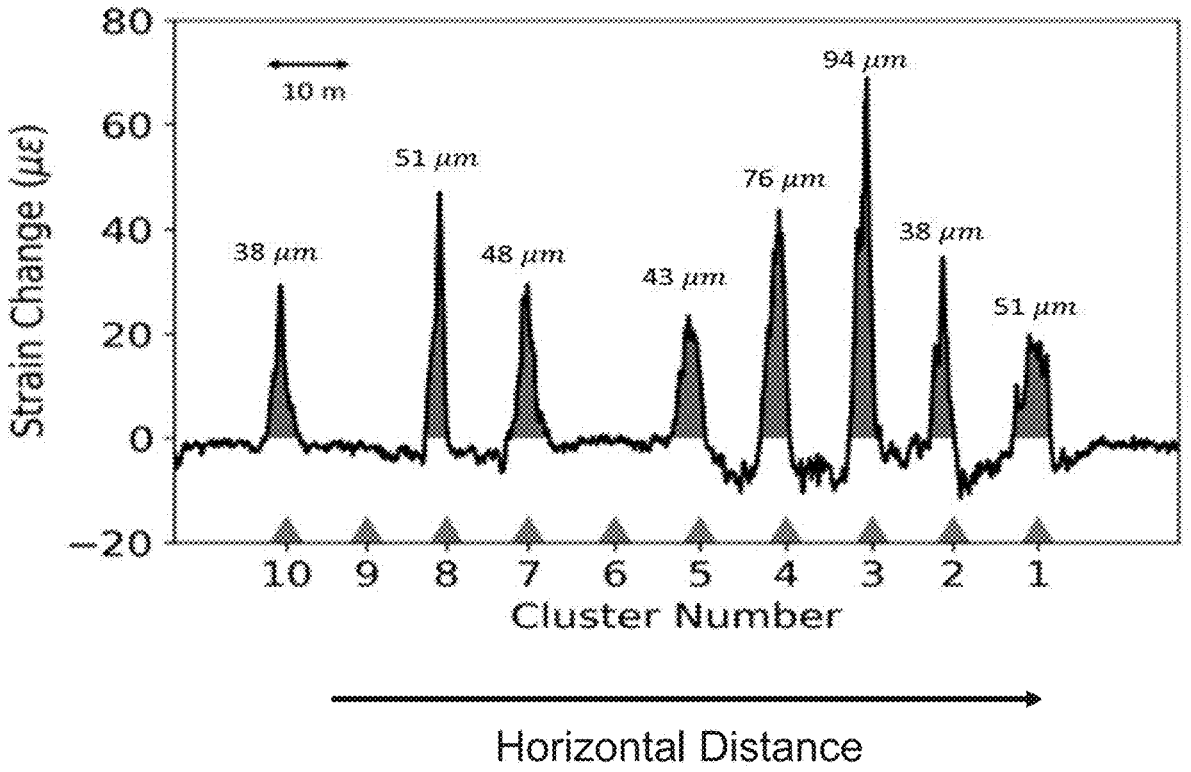

FIG. 5B shows an illustrative graphical representation of distributed strain measurements as a function of the perforation cluster number. The cluster is located in a horizontal well. The 10-meter scale illustrated in FIG. 5B is significant, as it demonstrates that the distributed strain measurement resolution can be sufficiently high for perforation by certain conventional perforation guns. This 10-meter scale can be achieved, for example, by virtue of the use of DFOS technology.

Referring again to FIG. 2, a plug 204 is set in the second production well B, for example below the hydraulic fracture 202, and the wall 208 of the second production well B is perforated at the identified location, as shown in FIG. 2(*b*). This perforation 210 (see FIG. 4) can create a flow path between the first and second production wells A, B through the hydraulic fracture(s). For example, gun perforation can be an inexpensive method of perforating the production well wall 208.

By contrast, in conventional systems, hydraulic fractures from a first well may propagate near a second well, but perforations are not created in the second well casing or wall based on identified locations of hydraulic fractures originating from the first well. As such, the pressure inside the fractures is only linked to the first well.

Hydraulic fracturing fluid is injected from the first production well A, through the hydraulic fracture(s) 202, and into the second production well B. Fluid is extracted from the second production well B as fluid is injected into the first production well A, through the hydraulic fracture(s) 202, and into the second production well B. This can generate flow between the production wells A, B, and at higher pressure and thus speed compared to conventional systems, which can help push proppant 203 further away from the first production well A and into the hydraulic fracture(s) 202 connecting the production wells A, B. This method can be less costly than drilling new wells. With methods and systems according to the present disclosure, the fracture need not be increased to unpractical scales, and conductivity can be increased to establish long-term recovery from a reservoir. In some cases, the recovery rate can be increased twofold compared to conventional systems, and the number of wells needed can be reduced.

Alternatively, hydraulic fracturing fluid is injected from the second production well B, through the hydraulic fracture(s) 202, and into the first production well A, yielding similar advantages.

The method further includes stopping injection into the first production well A when sand can be observed at the second production well B, or a designed or predetermined injection volume is met.

A similar process can be performed between the second and third production wells B, C, as shown in FIG. 2(*c*). For example, the method can further include hydraulically fracturing the second production well B to form at least one hydraulic fracture 202 of the second production well, identifying, from the third production well C, at least one location of those hydraulic fracture(s) 202, and perforating a wall of the third production well C at the location(s).

This process can be repeated until all adjacent wells are completed for a current stage. At the last well of the sequence, as shown in FIG. 2(*d*), a conventional hydraulic fracturing stage can be performed. Subsequently, the next stage of the first production well A can be injected, and the process can be repeated until all the production wells are completed. Alternatively, all stages of the first production well A may be completed first, prior to proceeding with another well.

Figure 6:
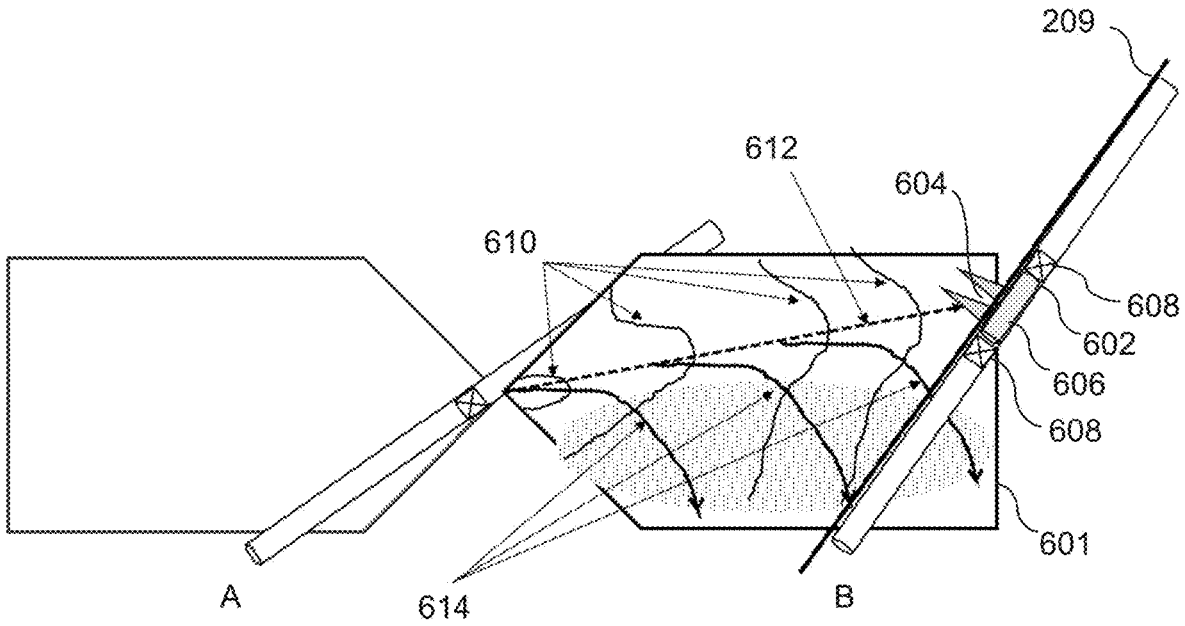
FIG. 6 shows an illustrative graphical representation of flow from the first production well to the second production well.

FIG. 6 shows an illustrative graphical representation of flow from a first horizontal production well A to a second horizontal production well B. As illustrated, in some exemplary embodiments, a pressure operation chamber 602 at the perforation site 604 can be operated using a coiled tubing 606 between two packers 608, and pressure can be controlled therein by injection of fluid. FIG. 6 shows the flow speed distribution 610 inside a planar crack 601. The maximum flow speed channel inside the planar crack 601 is illustrated by the dotted arrow 612, which runs from a perforate cluster in the well A to a remote penetrated perforated point in the well B. Proppant also "falls down" to opened crack spaces (see proppant traces 614 in FIG. 6) and accumulates there. This accumulation can create a channel for hydrocarbon recovery. In other words, this arrangement can benefit from maximum flow speed along a channel running from one production well to another, in view of desirable proppant spread within the channel.

It will be appreciated by those skilled in the art that the disclosure herein can be embodied in other specific forms without departing from the spirit or essential characteristics thereof. The presently-disclosed embodiments are therefore considered in all respects to be exemplary and not restricted. The scope of the invention is indicated by the appended claims rather than the foregoing description and all changes that come within the meaning and range and equivalence thereof are intended to be embraced therein.

What is claimed is:

1. A method for creating a fluid communication path between production wells including a first production well and a second production well, wherein at least one hydraulic fracture intersects the first production well and is separated from the second production well by a wall of the second production well, the method comprising:

identifying, from the second production well, at least one location of the at least one hydraulic fracture of the first production well;

perforating the wall of the second production well at the at least one location, wherein the perforating creates the fluid communication path between the production wells; and deploying optical sensing fibers in the second production well, the optical sensing fibers being configured to sense, from the second production well, the at least one hydraulic fracture of the first production well.

2. The method of claim 1, wherein the first and second production wells are first and second horizontal production wells, respectively.

3. The method of claim 1, comprising:

setting a plug in the second production well prior to perforating the wall of the second production well at the at least one location.

4. The method of claim 1, comprising:

hydraulically fracturing the first production well to form the at least one hydraulic fracture.

5. The method of claim 1, comprising:

injecting hydraulic fracturing fluid from the first production well, through the at least one hydraulic fracture, and into the second production well.

6. The method of claim 5, comprising:

extracting the hydraulic fracturing fluid from the second production well as hydraulic fracturing fluid is injected into the first production well, through the at least one hydraulic fracture, and into the second production well.

7. The method of claim 6, comprising:

pushing, by pressure, proppant into the first production well and into the at least one hydraulic fracture toward the at least one location of the perforating of the wall of the second production well.

8. The method of claim 1, comprising:

injecting hydraulic fracturing fluid from the second production well, through the at least one hydraulic fracture, and into the first production well.

9. The method of claim 1, comprising:

hydraulically fracturing the second production well to form at least one second production well hydraulic fracture;

identifying, from a third production well, at least one location of the at least one second production well hydraulic fracture; and perforating a wall of the third production well at the at least one location of the at least one second production well hydraulic fracture.

* * * * *